US008307677B2

(12) United States Patent
Larson et al.

(10) Patent No.: US 8,307,677 B2
(45) Date of Patent: Nov. 13, 2012

(54) KEY CONTAINER WITH SECURITY LINER

(75) Inventors: Wayne Larson, Salem, OR (US); Matthew S. Hill, Sublimity, OR (US); Jon Marc Luebeck, Stayton, OR (US)

(73) Assignee: UTC Fire & Security Corporation, Farmington, CT (US)

( * ) Notice: Subject to any disclaimer, the term of this patent is extended or adjusted under 35 U.S.C. 154(b) by 0 days.

(21) Appl. No.: 12/985,447

(22) Filed: Jan. 6, 2011

(65) Prior Publication Data

US 2012/0174637 A1 Jul. 12, 2012

(51) Int. Cl.
*A44B 15/00* (2006.01)
*A45C 11/32* (2006.01)
*A47G 29/10* (2006.01)

(52) U.S. Cl. ..... 70/456 R; 70/63; 70/459; 70/52; 70/54; 70/55; 70/56; 70/57; 70/58; 220/23.89

(58) Field of Classification Search ..... 70/63, 456 R, 70/459, 52, 38 A, 54, 55, 56, 57, 58; 206/37.1, 206/37.2, 37.3, 37.4, 37.5, 37.6, 37.7, 37.8, 206/38.1; 220/23.89, 23.87, 23.86, 23.83
See application file for complete search history.

(56) References Cited

U.S. PATENT DOCUMENTS

| | | | | |
|---|---|---|---|---|
| 3,979,932 | A * | 9/1976 | Piche | 70/63 |
| 4,609,780 | A * | 9/1986 | Clark | 379/102.06 |
| 4,649,723 | A * | 3/1987 | Appelbaum | 70/63 |
| 4,838,052 | A * | 6/1989 | Williams et al. | 70/63 |
| 5,280,518 | A * | 1/1994 | Danler et al. | 379/102.06 |
| 5,330,071 | A * | 7/1994 | Parker | 220/645 |
| 5,791,172 | A * | 8/1998 | Deighton et al. | 70/63 |
| 6,418,766 | B1 * | 7/2002 | Luebeck | 70/371 |
| 6,439,670 | B1 * | 8/2002 | Winters | 301/37.101 |
| 6,450,361 | B1 * | 9/2002 | Mendelson et al. | 220/202 |
| 6,467,646 | B2 * | 10/2002 | Schafer | 220/600 |
| 6,546,850 | B1 * | 4/2003 | Akiyama-Warren | 220/573.4 |
| 6,621,717 | B2 * | 9/2003 | Tuttle et al. | 361/818 |
| 6,813,912 | B1 * | 11/2004 | Ng et al. | 70/63 |
| 7,549,875 | B2 * | 6/2009 | Rambosek et al. | 439/136 |
| 2003/0179075 | A1 * | 9/2003 | Greenman | 340/5.54 |
| 2005/0168320 | A1 * | 8/2005 | Henderson et al. | 340/5.25 |

* cited by examiner

*Primary Examiner* — Lloyd Gall
*Assistant Examiner* — David E Sosnowski
(74) *Attorney, Agent, or Firm* — Cantor Colburn LLP

(57) ABSTRACT

A key containment apparatus includes a key container having a pocket and a liner positioned in the pocket of the key container, the liner being shaped to receive a key.

11 Claims, 3 Drawing Sheets

KEY CONTAINER WITH SECURITY LINER

BACKGROUND OF THE INVENTION

The subject matter disclosed herein relates key containers, more particularly, to a key container having a security liner.

Key containers are used in a variety of situations to retain a key to a home, business, automobile, etc. Authorized individuals can access the key by opening the key container, often by entering a combination to open a lock. This is common in the real estate field where a lockbox is used to contain a key to an entrance of a home. Other exemplary applications of key containers include "hide-a-key" products that enable a user to access a spare key when needed.

Die cast key containers have traditionally been used in lockboxes to block access to items housed in the box. Die castings provide the advantages of complex, rigid forms at low cost, but they are subject to cracking under a physical attack due to their brittle physical characteristics. Formed sheet metal key containers, on the other hand, have walls that are tougher to crack but cannot be formed into complex shapes. Thus, there is a need in the art for an improved key container providing enhanced security features.

BRIEF DESCRIPTION

According to one aspect of the invention a key containment apparatus includes a key container having a pocket; and a liner positioned in the pocket of the key container, the liner being shaped to receive a key.

According to another aspect of the invention, a method for containing a key includes providing a key container having a pocket; and providing a liner positioned in the pocket of the key container, the liner being shaped to receive a key.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
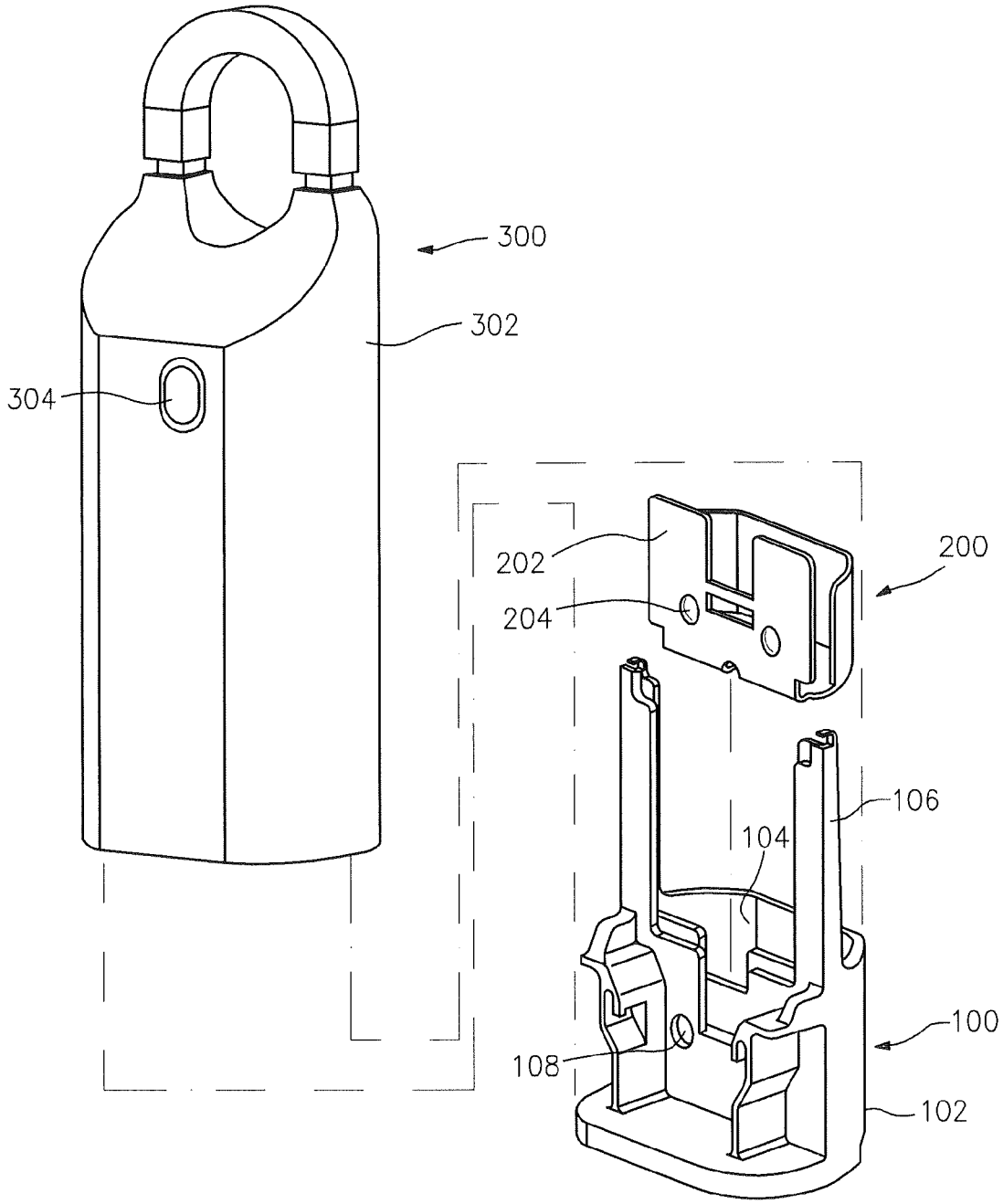
FIG. 1 is an exploded, perspective view of a key container, a liner and a housing.

FIG. 1 is an exploded, perspective view of a key containment apparatus including a key container 100, liner 200 and housing 300. The key container 100 is a die cast structure. The use of die cast forming techniques allows the key container 100 to have a variety of complex shapes. A base section 102 includes a pocket 104 for holding a key. Arms 106 extend away from the base section 102 and coact with housing 300.

Housing 300 includes an outer shell 302 and a lock 304. Lock 304 may be a mechanically or electrically actuated lock. The housing 300 includes mechanical locking features (not shown) for engaging arms 106 of the key container 100 to secure the key container 100 to the housing 300.

Figure 2:
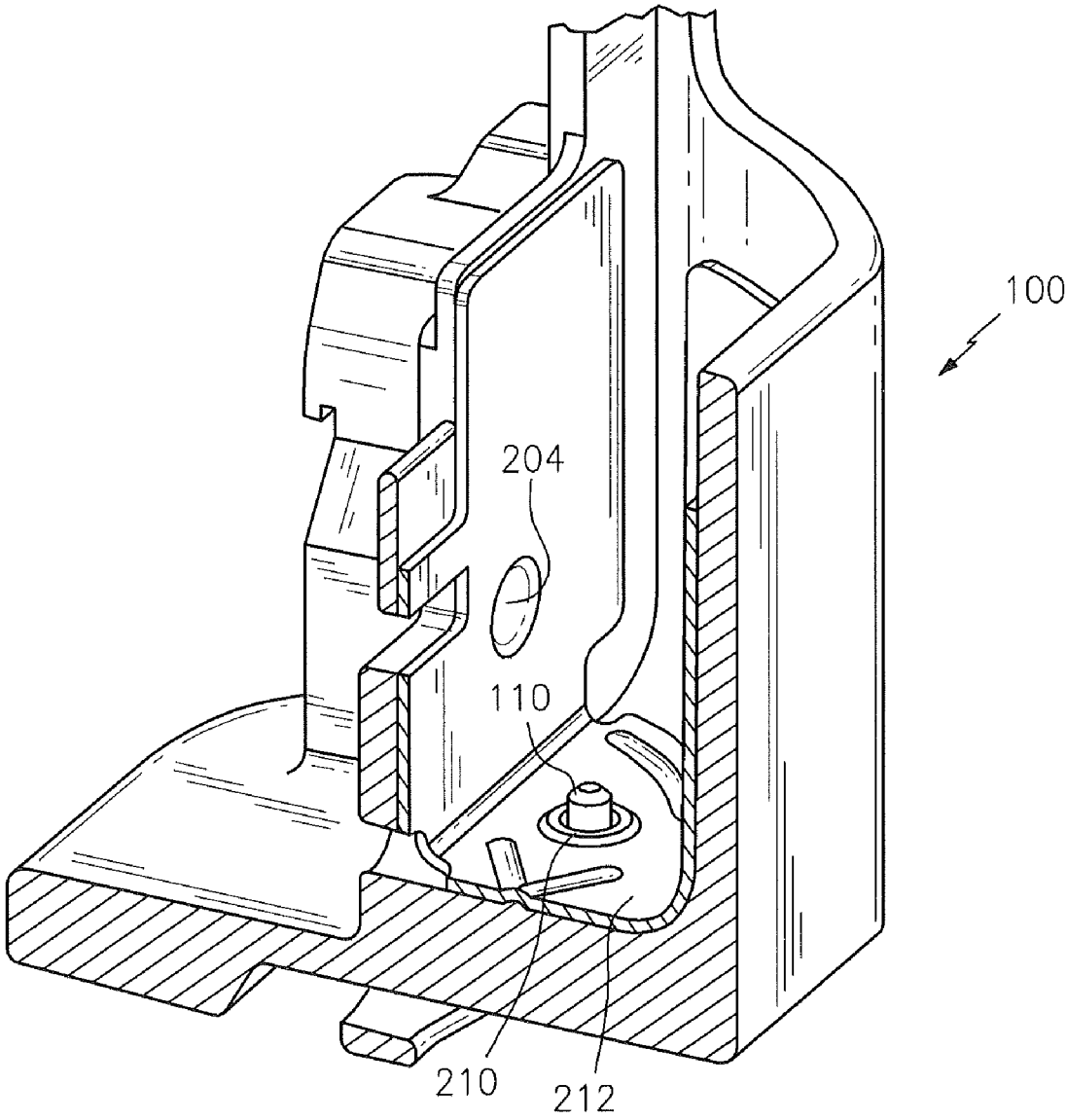
FIG. 2 is a cross-sectional, perspective view of the key container and liner of FIG. 1, the liner being in a first position.

Liner 200 is generally u-shaped for receiving a key, and includes four walls and a base. Liner 200 may be made from a sheet of metal (e.g., steel, stainless steel) that is cut and bent to be generally similar in shape to pocket 104. One wall 202 of liner 200 includes two detents 204. Detents 204 are received in openings 108 in the pocket 104 of key container 100. It is understood that more or less detents 204 may be used, and the detents may be located on one or multiple walls of liner 200. As shown in FIG. 2, the bottom surface of pocket 104 includes two nubs 110 (one of which is shown in FIG. 2). Nubs 110 engage holes 210 in base 212 of liner 200 to align liner 200 with recess 104. Nubs 110 also serve to removably secure liner 200 to container 100 through a frictional fit between the nubs 110 and holes 210. The liner 200 may be further secured to key container 100 by swaging nubs 110 to provide an increased interference between the nubs 110 and holes 210. The swaging of nubs 110 should not be such that the liner 200 cannot breakaway from the key container 100 upon attack, as described in further detail herein.

In use, the liner 200 is inserted into pocket 104 and the key placed in the confines of liner 200. As shown in FIG. 2, the liner 200 is inserted fully into key container 100, referred to as a first position. Detents 204 engage openings 108 to removably secure the liner 200 to key container 100. As described below in further detail with reference to FIG. 3, the liner 200 may be dislodged from the key container 100 upon attack. Once the liner 200 and key are positioned in key container 100, the key container 100 is then inserted into housing 300. The locking mechanism of housing 300 engages arms 106 to secure key container 100 to housing 300.

Figure 3:
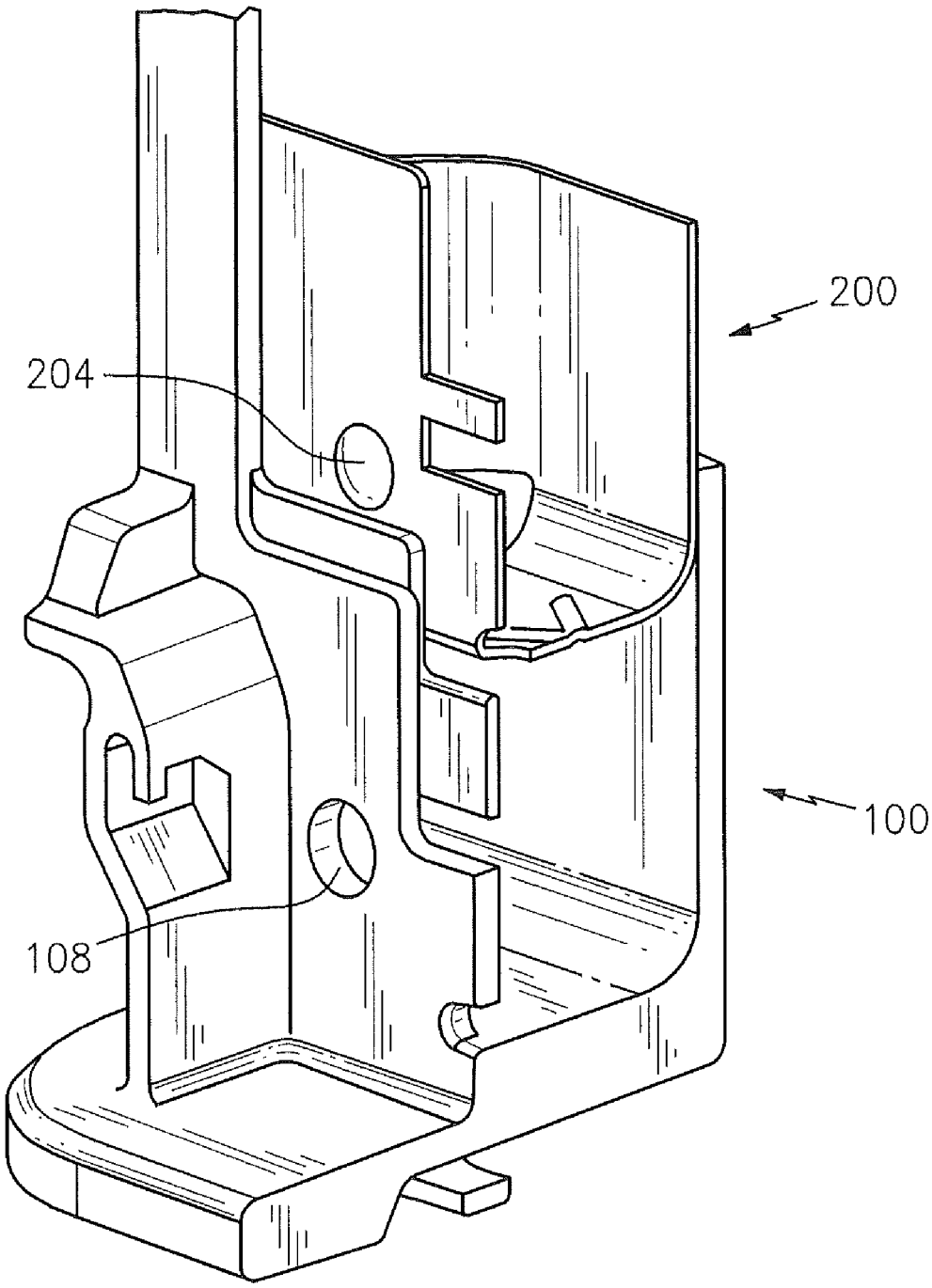
FIG. 3 is a cross-sectional, perspective view of the key container and liner of FIG. 1, the liner being in a second position.

FIG. 3 is a cross-sectional, perspective view of the key container 100 and liner 200 of FIG. 1, with the liner 200 being in a second position. If an individual attempts to break into the housing 300, the liner 200 provides two security features. First, during a physical attack, if a hole is made in the die cast key container 100, the tough inner liner 200 is exposed. Further attack carried out on the liner 200 results in detents 204 being dislodged from openings 108. The allows the liner 200 to move into a more protected, second location within the key container 100 and housing 300, while encapsulating the key within liner 200.

Embodiments of the invention provide a tough, stainless steel inner liner 200 to back up the die cast key container 100. The liner 200 provides the toughness that is lacking in the die cast container 100. The liner 200 is mounted in such a way that it remains out of the way while in normal use. The anti-attack resistance of the stainless steel liner 200 is gained at minimal cost, while maintaining the low cost and complex form advantages of the cast container.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A key containment apparatus comprising:

a key container having a base section having a pocket and an arm extending from the base section;

a liner positioned in the pocket of the key container, the liner directly frictionally engaging the pocket of the key container, the liner being shaped to receive a key, the liner being a separate element from the key container; and a housing for receiving the key container, the housing engaging the arm to secure the key container to the housing;

wherein the liner is removably secured to the key container, the liner dislodging from the key container upon force applied to the housing with the key container secured to the housing.

2. The key containment apparatus of claim 1 wherein:

the key container is die cast.

3. The key containment apparatus of claim 1 wherein:

the liner is made from a sheet of metal.

4. The key containment apparatus of claim 3 wherein:

the liner is made from a sheet of steel.

5. The key containment apparatus of claim 1 wherein:

the liner includes a detent and the key container includes an opening for receiving the detent to removably secure the liner to the key container.

6. The key containment apparatus of claim 5 wherein:

the liner includes two detents and the key container includes two openings for receiving the detents to removably secure the liner to the key container.

7. The key containment apparatus of claim 1 wherein:

a base of the liner includes a hole;

a bottom surface of the pocket includes a nub for engaging the hole in the liner.

8. The key containment apparatus of claim 7 wherein:

the nub is in frictional engagement with the hole.

9. The key containment apparatus of claim 8 wherein:

the nub is swaged.

10. A key containment apparatus comprising:

a die cast key container having a base section having a pocket and an arm extending from the base section;

a sheet metal liner positioned in the pocket of the key container, the liner directly frictionally engaging the pocket of the key container, the liner being shaped to receive a key, the liner being a separate element from the key container; and a housing for receiving the key container, the housing engaging the arm to secure the key container to the housing;

wherein the liner is removably secured to the key container, the liner dislodging from the key container upon force applied to the housing with the key container secured to the housing;

wherein the liner includes a detent and the key container includes an opening for receiving the detent to removably secure the liner to the key container;

wherein a base of the liner includes a hole and a bottom surface of the pocket includes a nub for engaging the hole in the liner.

11. The key containment apparatus of claim 10 wherein:

the liner includes two detents and the key container includes two openings for receiving the detents to removably secure the liner to the key container.

* * * * *